United States Patent [19]

Cox

[11] Patent Number: 4,604,628

[45] Date of Patent: Aug. 5, 1986

[54] PARASITIC ARRAY WITH DRIVEN SLEEVE ELEMENT

[75] Inventor: Roger A. Cox, Lincoln, Nebr.

[73] Assignee: Telex Communications, Inc., Lincoln, Nebr.

[21] Appl. No.: 474,557

[22] Filed: Mar. 11, 1983

[51] Int. Cl.[4] ..... H01Q 21/12

[52] U.S. Cl. ..... 343/818; 343/722; 343/792

[58] Field of Search ..... 343/722, 745, 747, 749, 343/752, 790, 802, 820, 810–819, 823, 791, 792, 834, 837

[56] References Cited

U.S. PATENT DOCUMENTS

| | | | |
|---|---|---|---|
| Re. 24,413 | 1/1958 | Weiss | 343/815 |
| 2,975,423 | 3/1961 | Wells | 343/819 |
| 3,064,257 | 11/1962 | Guest | 343/802 |
| 3,176,298 | 3/1965 | Nettles | 343/749 |

OTHER PUBLICATIONS

A.R.R.L., "Parasitic Arrays", The A.R.R.L. Antenna Book, Ch. 6, pp. 6–14 to 6–23, published by the American Radio Relay League, Inc., Newington, Conn., 1983.

*Primary Examiner*—Eli Lieberman
*Assistant Examiner*—Michael C. Wimer
*Attorney, Agent, or Firm*—Vincent L. Carney

[57] ABSTRACT

To provide broad bandwidth in a multiple-band directional antenna, the antenna includes an array of parallel horizontal elements, which are: (1) an open-sleeve dipole as the driven element; (2) a trap director element; and (3) trap reflector elements. The driven element includes: (1) a trap central dipole which is center-fed and has sections self-resonant within the bands of 21.0 to 21.45 megahertz and 14.0 to 14.35 megahertz; and (2) two unequal-length sleeves self-resonant at 28.0 to 29.7 megahertz. The director and reflector elements are resonant in the same bands and are spaced and tuned for directivity of the array.

12 Claims, 3 Drawing Figures

PARASITIC ARRAY WITH DRIVEN SLEEVE ELEMENT

BACKGROUND OF THE INVENTION

This invention relates to parasitic antenna arrays.

Parasitic arrays with linear elements such as dipole-type elements are known in the art to provide directional transmission and reception with a high front-to-back ratio. Such antennas are frequently called Yagi-Uda antennas and they contain, in most embodiments, a driven element, one or more director elements and a reflector element. Under some circumstances, Yagi-Uda antennas have the disadvantage of a less-than-desirable bandwidth.

Omnidirectional open-sleeve dipole antennas are known and have the advantages of being sturdy, light and broadband. Moreover, it is known that a cavity reflector used with such an open-sleeve dipole provides a broadband, directional antenna in VHF and UHF antennas. However, such antennas are bulky, expensive and satisfactory only for some frequency bands.

SUMMARY OF THE INVENTION

Accordingly, it is an object of the invention to provide a novel antenna.

It is a further object of the invention to provide a novel multiple-band, directional antenna.

It is a still further object of the invention to provide a novel Yagi-Uda antenna.

It is a still further object of the invention to provide a novel method and apparatus for obtaining high gain and broad bandwidth in a directional, multiple-band antenna of relatively small size.

It is a still further object of the invention to provide a novel system for transmitting signals in a plurality of bands.

It is a still further object of the invention to provide a Yagi-Uda antenna with an open-sleeve dipole as the driven element.

It is a still further object of the invention to provide an open-sleeve trap antenna in which the sleeve is self-resonant in one frequency band.

In accordance with the above and further objects of the invention, a multiple-band Yagi-Uda antenna includes an open sleeve dipole as its driven element. Loading is reduced by using sleeves which are self-resonant at least in one of the frequency bands of the antenna.

Advantageously, the sleeve sections are of different lengths and self-resonant in one frequency band while the central conductor is self-resonant in at least one different-frequency band and not self-resonant in the same band as the sleeve. The rear sleeve element is shorter than the front sleeve element.

It has been discovered that an open-sleeve dipole within a Yagi-Uda antenna provides good bandwidth and gain in a relatively small, inexpensive antenna. This bandwidth is improved by using sleeves that are self-resonant in one frequency band and by using different length front and back sleeves. The driven element is the central conductor of the open-sleeve dipole and includes trap sections for self-resonance in bands other than the one in which the sleeve is self-resonant.

In the preferred embodiment, the antenna includes: (1) a three-band director; (2) a centrally located open-sleeve driven element; (3) a single-band reflector element; and (4) a separate two-band reflector.

To provide three-band operation, the driven element includes: (1) a centrally located portion tuned for the middle frequency band, terminated on each end by parallel tuned circuit traps for the middle frequency band; (2) two end sections, forming with the central section and traps, a dipole tuned as a unit for the lowest frequency band; and (3) two sleeves of unequal length tuned for the highest frequency band. In another embodiment, the director is also an open-sleeve element with traps, two-band central conductor and sleeves self-resonant at one frequency.

This antenna has several advantages, such as: (1) good front-to-back ratio; (2) relatively small size, light weight and sturdy construction; and (3) broad bandwidth.

SUMMARY OF THE DRAWINGS

The above-noted and other features of the invention will be better understood from the following detailed description when considered with reference to the accompanying drawings, in which.

DETAILED DESCRIPTION

Figure 1:
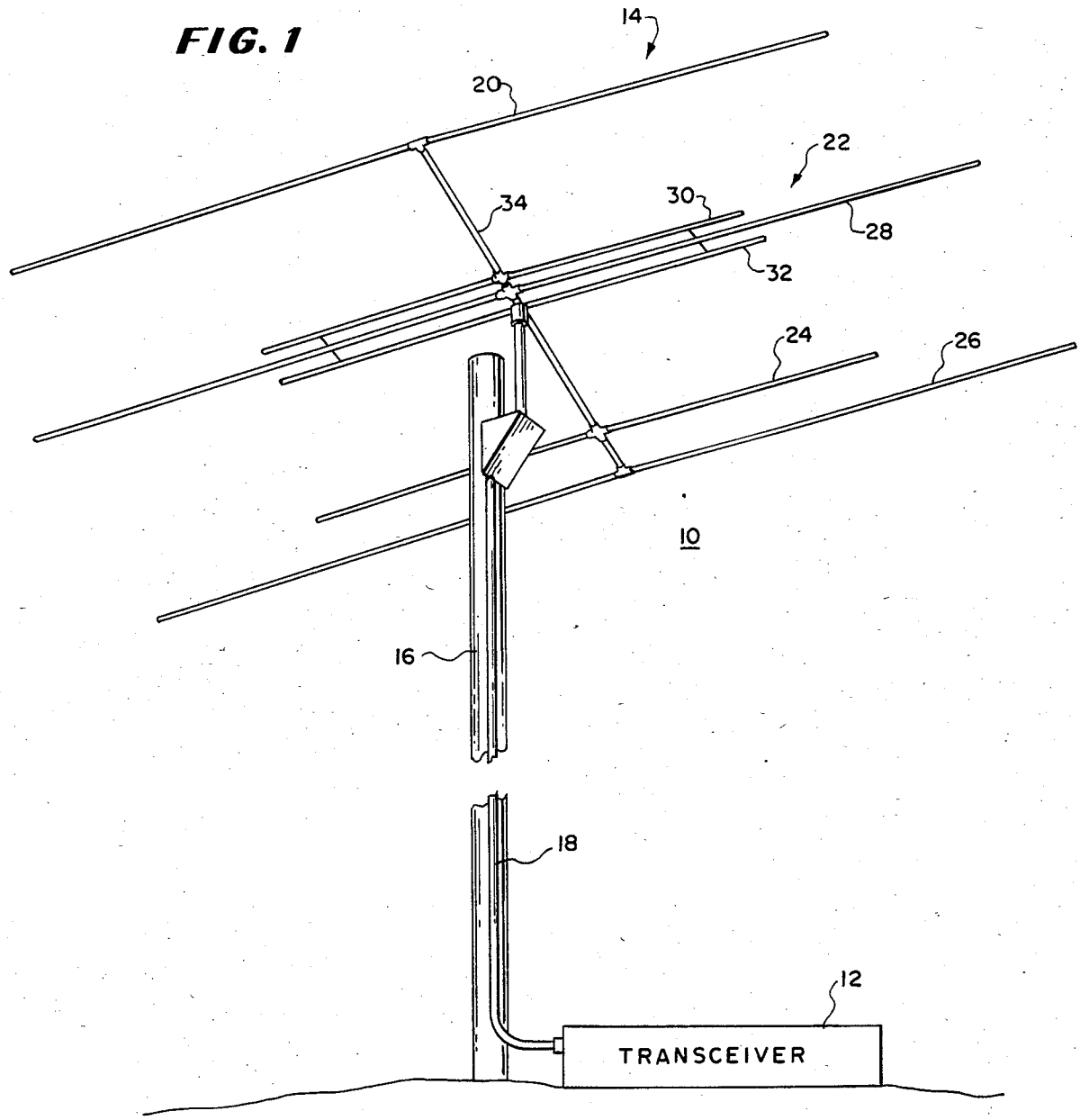
FIG. 1 is a simplified, partly broken-away perspective view of an antenna system in accordance with an embodiment of the invention.

In FIG. 1, there is shown a directional multiband antenna system 10, electrically connected to a transceiver 12 to receive or transmit signals in any of several frequency bands. The antenna system includes an antenna array 14 mounted to a column support 16 and electrically connected to the transceiver 12 by a transmission line 18.

The antenna array 14 is a multiparasitic array, sometimes referred to as a Yagi-Uda array, which in the preferred embodiment includes as its elements: (1) a single three-band trap direction 20; (2) a driven element 22; and (3) two reflectors 24 and 26. The director, driven element and reflectors are mounted perpendicularly to the horizontal boom 34 at their midpoints in the same horizontal plane. The number of elements has been selected to provide a reasonable size for selected bands within the high-frequency region with high directivity, bandwidth and gain.

The driven element 22: (1) is coupled to the transceiver 12; (2) is inductively coupled to the director 20 and to the reflectors 24 and 26; and (3) is an open-sleeve dipole having a central dipole 28 and two parasitic elements 30 and 32 on each side of the dipole 28, all positioned in a horizontal plane along with the elements 20, 24 and 26.

As best shown in FIG. 1, the elements and sleeves are arranged parallel to each other in the horizontal plane in the following order: director element 20, sleeve 30, driven conductor 28, sleeve 32, reflector element 24 and reflector element 26. In the preferred embodiment, the antenna operates in a selected one of three bands.

Advantageously, the highest frequency band is between 28.0 and 29.7 megahertz (MHz), the middle frequency is 21.0 to 21.45 MHz and the lowest frequency band is 14.0 to 14.35 MHz. The director and reflectors are from 0.1 to 0.3 wavelength from the driven element.

Surprisingly, the three bands cover more than a two-to-one frequency range with a VSWR of less than two-to-one within each band with only a single pair of sleeves on the open-sleeve dipole.

To form the open-sleeve dipole, the driven element 22 is mounted with the sleeves 30 and 32 parallel to the longitudinal axis of the dipole 28 and positioned sufficiently close to act in a manner resembling a three-conductor transmission line. The distance between the sleeves is between four and twelve times their diameters.

To provide directivity to each of the bands, the reflectors and director contain nested sections, each of which is resonant in a different one of the three selected bands and is positioned a distance from the driven element 22 of between 0.1 and 0.3 wavelength of their frequency, and preferably at 0.2 wavelength for efficient operation, from the driven element.

Figure 2:
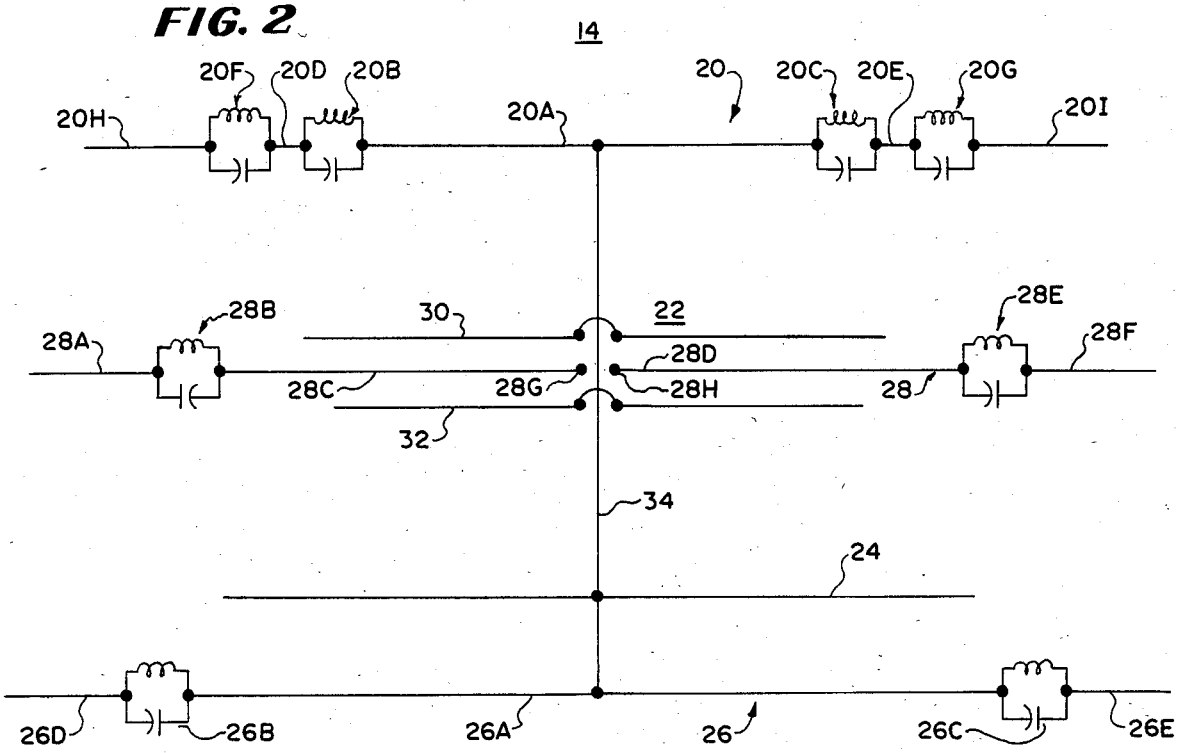
FIG. 2 is a schematic diagram of a portion of the antenna system of FIG. 1.

In FIG.2, there is shown a schematic diagram of the antenna 14, representing each of the element 20, 22, 24 and 26 by their electrical characteristics. As best shown in this figure, the driven element 22 is electrically insulated from the director, reflectors and sleeves and has its central dipole 28 directly coupled through a central feed point to the transmission line 18 (FIG. 1) at terminals 28G and 28H for reception of electrical power. This connection may be through any conventional impedance-matching device and in the preferred embodiment, a beta match is used.

The central dipole 28 is a conductive tube, extending horizontally outwardly from the midline of the antenna and forming a dipole between the sleeves 30 and 32. The sleeves 30 and 32 are also conductive tubes and are spaced at substantially equal diameters from the central dipole 28 but on opposite sides. In the preferred embodiment, the distance between the sleeves and the central dipole is approximately six times the diameter of the tubular conductor 28. The sleeves and central conductor are parallel throughout their lengths and within the same plane.

The central dipole 28 forms two nested half-wave dipole sections, each self-resonant within a different one of the two frequency bands of 21.0 to 21.45 MHz and 14.0 to 14.35 MHz, which are the lowest and middle frequencies. The dipole sections for the middle frequency and the lowest dipole section are center-fed directly from the transmission line.

The middle-frequency dipole section extends from the feed points 28G and 28H through the aligned self-resonant tubular portions 28C and 28D to the traps 28B and 28E, which are parallel resonant circuits tuned to the middle band of 21.0 to 21.45 MHz. The lowest-frequency section extends from the feed points 28G and 28H, through: (1) the aligned tubular conductors 28C and 28D; (2) the traps 28B and 28E; and (3) the tubes 28A and 28F. The tubes 28A and 28F, together with tubes 28C and 28D and traps 28B and 28E, form a length which is self-resonant in the lowest frequency band between 14.0 and 14.35 MHz to provide the second dipole section.

With this arrangement, the central conductor 28 is self-resonant in either of the middle and lowest frequency bands when driven. When resonating in either of these frequency bands, relatively little voltage is induced in the sleeve portions 30 and 32. The sleeves 30 and 32 are, like the dipole 28, insulated from the boom 34 but may not be if they are perpendicular to it. They are self-resonant in the highest frequency band, which in the preferred embodiment is 28.0 to 29.7 MHz. The sleeve 30 is approximately one half-wavelength at the self-resonant frequency and the sleeve 32 is shorter than the sleeve 30 by the distance between the two sleeves. They are symmetrical to the boom 34.

Surprisingly, the sleeves reduce VSWR over several bands spaced widely in frequency although they are not self-resonant in all of those frequencies. This permits multiband use of the antenna with the bands having frequency ratios larger than two-to-one. The use of self-resonant sleeves eliminates the need for many traps while permitting an inexpensive, compact multiband antenna by reducing loading.

The director element 20 is positioned to receive energy from the driven element 22 and to create an additive field at each of the bandwidths for which the driven element 22 is self-resonant. For this purpose, the director element 20: (1) is a trap element having a plurality of nested sections; (2) includes a section for each frequency; (3) has an electrical length for each of its sections that is from 0.9 to 0.95 times the electrical half-wavelength of the frequency for which the section is self-resonant; and (4) is electrically connected to and supported by the boom 34 at a center to be symmetrical about it.

To provide directional gain in the highest frequency band, the central section 20A is tuned to the highest frequency and is terminated at its ends by the traps 20B and 20C which provided parallel resonance for the highest frequency. In this embodiment, the highest frequency is 28.0 to 29.7 MHz.

To provide directional gain in the middle frequency band, a section of tubing 20D extends from the trap 20B to elongate one end of the direction 20 and a tubular conductor 20E elongates the other end so that, together, the elements 20A, 20B, 20C, 20D and 20E are resonant to the middle frequency, which in this case is 21.0 to 25.45 MHz. The tubular conductors 20D and 20E are terminated at the respective outer ends by the traps 20F and 20G, which are resonant at the middle frequency.

To provide directional gain in the lowest frequency band, the tubular conductors 20H and 20I are connected to and extend from the traps 20F and 20G. The combination of the elements 20A, 20B, 20C, 20D, 20E, 20F, 20G, 20H and 20I are self-resonant at the lowest frequency band, which is 14.0 to 14.35 MHz. With this arrangement, the frequency applied to the driven element 22 is radiated to the director 20 and, there, induces a voltage in the appropriate sections, which results in a current that provides an additive directional field. The field is additive in the direction proceeding from the driven element to the director.

On the opposite side of the driven element 22, the reflectors 24 and 26 are mounted in the same horizontal plane as the director and driven elements and have sections tuned to be self-resonant in the same bands as the driven element. Each section has an electrical length of from 1.05 to 1.1 times the electrical half-wavelength of the frequency band for which it is a reflector.

The reflector 24 is a conductive tube electrically connected to and physically supported by the boom 34 and extends from each side symmetrical and parallel to the elements 20, 22 and 26. It has a length which provides single-band self-resonance to frequencies in the highest frequency band, which in the preferred embodiment is 28.0 to 29.7 MHz. It has a voltage induced in it which creates a current and electromagnetic field phased to direct energy toward the driven element 22 and the director element 20. It is spaced approximately 0.2 wavelength from the driven element 22.

The reflector 26 includes first and second tubular, cylindrical conductive sections nested together symmetrically about the boom 34 and separated by traps, with: (1) the central tube 26A being connected to the boom; (2) traps 26B and 26C being at is ends; and (3) tubes 26D and 26E being aligned with the tube 26A and extending from the traps 26B and 26C, respectively, at opposite ends of the tube 26A. The reflector 26 is parallel to and in the same plane as the elements 20, 22 and 24.

The central conductor 26A is self-resonant at the frequencies in the band from 21.0 to 21.45 MHz and the traps 26B and 26C provide parallel resonance to the tuned frequency of the conductor 26A. The cylindrical, tubular conductors 26D and 26E are, with the elements 26B, 26A and 26C, self-resonant at the lowest frequency band, which is 14.0 to 14.35 MHz. The two nested sections of the reflector 26 are spaced approximately 0.1 to 0.3 wavelength from the director. Accordingly, the reflector 26 directs the energy toward the driven element 22 and director 20 in the two lower frequency bands.

In the preferred embodiment, the director 20A is formed of four telescoping tubes. The first two tubes are adjacent to the boom, have a diameter of one and one-quarter inches and are forty-eight inches long on each side. The second two tubes have diameters of one and one-eighth inches and telescope within the first two tubes. They have a length of $31\frac{7}{8}$ inches but are telescoped to result in the tube portion near the boom being 48 inches while the portion extending from the boom of the narrower tube is 26 inches to form a total length of 150 inches, including the 2 inch diameter boom.

The director elements 20E and 20D are each formed of one inch diameter tubes, six inches long and the director elements 20H and 20I are each formed of 7/16 inch diameter tubes, 28 inches long, but form a total element 33 inches long when combined with portions of the traps 20F and 20G.

The sleeve 30 is formed of four tube sections, with the tubes extending radially outwardly from the boom 34 being five-eighths of an inch in diameter and 48 inches long. Smaller tubes extend $48\frac{1}{2}$ inches further from each end and have a diameter of seven-sixteenths inch tube. They have a full length of $52\frac{5}{8}$ inches long each but are telescoped into the larger tubes to provide a combined length of 195 inches, including the 2 inch diameter boom.

The sleeve 32 is formed of the same size pipes as the sleeves 30 but the outer pipes are telescoped slightly further inwardly to extend $44\frac{1}{2}$ inches and thus make a combined length of 187 inches.

The dipole element 28D is formed of two one and one-quarter inch diameter pipes, each 83 inches long extending outwardly from the boom 34 and two one and one-eighth inch tubes, 42 inches long telescoped within it to a length of $36\frac{1}{2}$ inches. The dipole element 28F and the dipole element 28A extend beyond the traps 28E and 28B respectively, $39\frac{1}{4}$ inches and include at their outer ends. seven-sixteenth diameter pipes 37 inches long but form a total element $39\frac{1}{4}$ inches long when combined with portions of the traps 28E and 28B.

The reflector 24 is formed of two, seven-eighths inch diameter pipes, 55 inches long extending from either side of the boom 34 each of which has telescoped within it five-eighths inch diameter pipes 26 inches long telescoped to 24 inches. Each of these pipes have telescoped within them a different seven-sixteenths inch diameter pipe which is $42\frac{3}{4}$ inches long telescoped to 38 inches in length to provide a total length of 236 inches, including the 2 inch diameter boom.

The reflector 26A is formed of a first pair of one and one-quarter inch pipes, 83 inches long, each extending from an opposite side of the boom 34. One and one-eighths inch diameter pipes, 55 inches long on each side are telescoped within the first pipes to a length of $50\frac{1}{2}$ inches to form a combined length of 269 inches, including the 2 inch diameter boom. The reflector elements 26D and 26E are each 42 inches long, which includes a seven-sixteenths inch pipe which is 37 inches long plus six inches from the adjacent traps 26B and 26C.

In the preferred embodiment, the director elements 20 are $58\frac{1}{2}$ inches from the sleeve element 30, the reflector 24 is 69 inches from the sleeve 32 and the reflectors 26 are 24 inches from the reflector 24. The dipole 28 is six inches from each of the sleeves 30 and 32, center to center.

Figure 3:
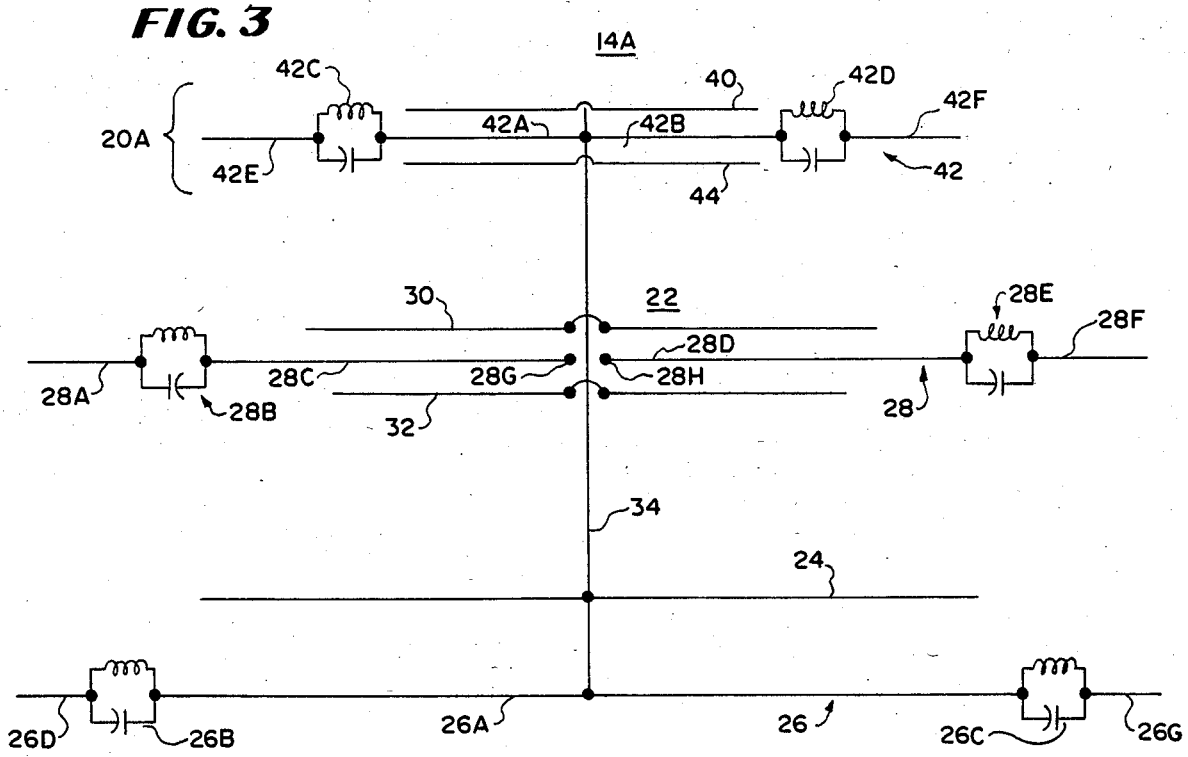
FIG. 3 is a schematic diagram of a portion of another embodiment of the invention.

In FIG. 3 there is shown a schematic diagram of another embodiment of antenna 14A representing each of the elements 20A, 22, 24 and 26 by their electrical characteristics and illustrating the use of an open sleeve dipole as an element in an array other than the driven element. In this embodiment, only the director differs from the embodiment of FIGS. 1 and 2 and other parts are indicated by the same reference number in FIGS. 1, 2 and 3. In this embodiment, the director 20A includes a first sleeve portion 40, a trap element 42 and a second sleeve portion 44. The trap element 42 includes two nested dipole sections.

To form the open-sleeve dipole, the director 20A is mounted with the sleeves 40 and 44 parallel to the longitudinal axis of the dipole 42 and positioned sufficiently close to act in a manner resembling a three-conductor transmission line. The distance between the sleeves is between four and twelve times their diameters.

The central dipole 42 is a conductive tube, extending horizontally outwardly from the midline of the antenna and forming a dipole between the sleeve portions 40 and 44. The sleeve portions 40 and 44 are also conductive tubes and are spaced at substantially equal distances from the central dipole 42 but on opposite sides. In the preferred embodiment, the distance between the sleeves and the central dipole is approximately six times the diameter of the tubular conductor 42. The sleeve portions 40 and 44 and the central conductor are parallel throughout their lengths and within the same plane.

The central dipole 42 forms two nested half-wave dipole sections, each self-resonant within a different one of the two frequency bands of 21.0 to 21.45 MHz and 14.0 to 14.35 MHz, which are the lowest and middle frequencies. The sleeves 40 and 44 are self-resonant in the highest frequency band, which is 28.0 to 29.7 MHz.

The middle frequency dipole section extends from the boom 34 through aligned, self-resonant tubular portions 42A and 42B to the traps 42C and 42D, which are parallel resonant circuits tuned to the middle band of 21.0 to 21.45 MHz. The lowest frequency section extends from the boom 34 through: (1) the aligned tubular conductors 42A and 42B; (2) the traps 42C and 42D; and (3) the tubes 42E and 42F. The tubes 42E and 42F, together with tubes 42A and 42B and traps 42C and 42D form a length which is self-resonant in the lowest frequency band between 14.0 and 14.35 MHz to provide the second dipole section.

From the above description, it can be understood that this antenna has several advantages, such as: (1) good front-to-back ratio; (2) relatively small size, light weight and sturdy construction; and (3) broad bandwidth.

Although a preferred embodiment of the invention has been described with some particularlity, many modifications and variations of the preferred embodiment are possible in the light of the teachings above without deviating from the invention. Accordingly, it is to be understood that, within the scope of the appended claims, the invention may be practiced other than as specifically described.

What is claimed is:

1. A Yagi-Uda antenna system for operation in first, second and third frequency bands, comprising:

a driven element adapted to be driven in at least said first frequency band and including a directly fed portion and first and second parallel sleeve portions;

said first sleeve portion having a predetermined diameter;

said first and second parallel sleeve portions being spaced from each other a distance of between four and twelve times and predetermined diameter;

said directly fed portion being positioned between said first and second sleeve portions;

said directly fed portion of said driven element including at least first, second and third portions; said first portion being self-resonant in said first frequency band and not in said second frequency band, said second portion forming a means for trapping frequencies in said first frequency band;

said first portion, second portion and third portion forming means self-resonant in said second frequency band;

said first and second sleeve portions being self-resonant in said third frequency band;

at least first and second parasitic element means each having portions self-resonant in certain of said first, second and third frequency bands, positioned at between 0.1 and 0.3 wavelength from said driven element and having electrical lengths for providing directivity;

said parasitic element means and sleeve portions being parallel to, in the same horizontal plane with an insulated from said driven element;

said first parasitic element means being a trap element director providing self-resonance in each of said first, second and third frequency bands and having electrical lengths of between 0.9 and 0.95 the electrical half-wavelengths of the first, second and third frequency bands; and the second parasitic element means being a trap element reflector having self-resonance in certain of said first, second and third frequency bands and electrical lengths of from 1.05 and 1.1 times the half-wavelengths of said frequency bands;

said first frequency band being between 21.0 to 21.45 megahertz; said second frequency band being between 14.0 to 14.35 megahertz and said third frequency band being between 28.0 to 29.7 megahertz.

2. An antenna system comprising:

a driven element adapted to be driven in a predetermined frequency band;

at least a first parasitic element;

said at least a first parasitic element having a portion self-resonant in said predetermined frequency band, positioned at betwen 0.1 and 0.3 wavelength from said driven element and tuned to form an additive field to the field of said driven element at said predetermined frequency band in a predetermined direction;

said at least a first parasitic element being parallel to said driven element;

said driven element including at least one directly fed portion and first and second sleeve portions;

said first sleeve portion having a predetermined diameter; and said first and second sleeve portions being spaced from each other a distance of between four and twelve times the predetermined diameter.

3. An antenna system comprising:

a driven element adapted to be driven in a first of a plurality of predetermined frequency bands;

at least a first parasitic element;

said at least a first parasitic element having a portion self-resonant in the first predetermined frequency band, positioned at between 0.1 and 0.3 wavelength from said driven element and tuned to form an additive field to the field of said driven element at said first predetermined frequency band in a predetermined direction;

said at least a first parasitic element being parallel to said driven element;

said driven element including at least one directly fed portion and first and second sleeve portions;

said first sleeve portion having a predetermined diameter;

said first and second sleeve portions being spaced from each other a distance of between four and twelve times the predetermined diameter; and a plurality of additional parasitic elements in addition to said first parasitic element and one of said additional parasitic elements being a director.

4. An antenna system according to claim 3 in which at least one of said additional parasitic elements is a reflector element which is self-resonant in at least one of said predetermined frequency bands.

5. An antenna system according to claim 4 in which the electrical length of said director is from 0.9 to 0.95 times the half-wavelength of a signal in at least one of said predetermined frequency bands.

6. An antenna system according to claim 5 in which the electrical length of said reflector is from 1.05 to 1.1 times the half-wavelength of a signal in at least one of said predetermined frequency bands.

7. An antenna system according to claim 3 in which the electrical length of said director is from 0.9 to 0.95 times the half-wavelength of a signal in at least one of said predetermined frequency bands.

8. An antenna system comprising:

a driven element adapted to be driven in a first of a plurality of predetermined frequency bands;

at least a first parasitic element;

said at least a first parasitic element having a portion self-resonant in said predetermined frequency band, positioned at between 0.1 and 0.3 wavelength from said driven element and tuned to form an additive field to the field of said driven element at said first predetermined frequency band in a predetermined direction;

said at least a first parasitic element being parallel to said driven element;

said driven element including at least one directly fed portion and first and second sleeve positions;

said first sleeve portion having a predetermined diameter;

said first and second sleeve portions being spaced from each other a distance of between four and twelve times the predetermined diameter; and a plurality of additional parasitic elements in addition to said first parasitic element and at least one of said additional parasitic elements being a reflector element which is self-resonant in at least one of said predetermined frequency bands.

9. An antenna system according to claim 8 in which the electrical length of said reflector is from 1.05 to 1.1 times the half-wavelength of a signal in said at least one predetermined frequency band.

10. An antenna system comprising:

a driven element adapted to be driven in a predetermined frequency band;

at least a first parasitic element;

said at least a first parasitic element having a portion self-resonant in said predetermined frequency band, positioned at between 0.1 and 0.3 wavelength from said driven element and tuned to form an additive field to the field of said driven element at said predetermined frequency band in a predetermined direction;

said at least a first parasitic element being parallel to said driven element;

said driven element including at least one directly fed portion and first and second sleeve portions;

said first sleeve portion having a predetermined diameter;

said first and second sleeve portions being spaced from each other a distance of between four and twelve times the predetermined diameter; and said first and second sleeve portions being parallel to each other and aligned in the same plane as the directly fed portion and the first parasitic element.

11. An antenna system according to claim 10 in which said first and second sleeve portions are parasitic elements.

12. An antenna system according to claim 11 in which said predetermined frequency band is between 28.0 and 29.7 megahertz.

* * * * *